US005771491A

United States Patent [19]

Bennett et al.

[11] Patent Number: 5,771,491

[45] Date of Patent: Jun. 30, 1998

[54] JACKET AND INTERCHANGEABLE LAPEL

[75] Inventors: Robert Bennett, Englewood, N.J.; John Galante, Watkinsville, Ga.

[73] Assignee: Chromalloy American Corp., Hackensack, N.J.

[21] Appl. No.: 863,076

[22] Filed: May 23, 1997

[51] Int. Cl.[6] ..... A41B 3/04

[52] U.S. Cl. ..... 2/98; 2/129; 2/60; 2/116; 2/132

[58] Field of Search ..... 2/60, 98, 100, 2/116, 129, 131, 132, 133, 139, 244

[56] References Cited

U.S. PATENT DOCUMENTS

| | | | |
|---|---|---|---|
| 1,059,542 | 4/1913 | Kaiser . | |
| 1,160,378 | 11/1915 | Cates . | |
| 1,548,564 | 8/1925 | Stern . | |
| 1,691,717 | 11/1928 | Hofer . | |
| 1,993,705 | 3/1935 | Kirschenbaum | 2/98 |
| 2,055,802 | 9/1936 | Prins . | |
| 2,138,041 | 11/1938 | Preston . | |
| 2,318,829 | 5/1943 | Zimmerman | 2/93 |
| 2,332,734 | 10/1943 | Lucas et al. | 2/93 |
| 2,535,205 | 12/1950 | Harry | 2/98 |
| 2,617,106 | 11/1952 | Pritzker . | |
| 2,634,420 | 1/1953 | Jackson . | |
| 2,920,328 | 1/1960 | Hammersley . | |
| 2,997,718 | 8/1961 | Jacobs . | |
| 3,127,617 | 4/1964 | Bonzi | 2/96 |
| 3,271,779 | 9/1966 | Dougherty . | |
| 4,651,347 | 3/1987 | Brown . | |

OTHER PUBLICATIONS

Oscar De La Renta Dimension II tuxedo, on sale prior to May 1996.

*Primary Examiner*—C. D. Crowder
*Assistant Examiner*—Shirra L. Jenkins
*Attorney, Agent, or Firm*—Mitchell D. Bittman

[57] ABSTRACT

A jacket is provided made with a conventional continuous folded collar and lapel and having a zipper for attaching an interchangeable collar and lapel member with the conventional collar and lapel providing support. and shape for the interchangeable member and at least a portion of the conventional collar and lapel is outwardly visible when the interchangeable member is attached.

2 Claims, 4 Drawing Sheets

JACKET AND INTERCHANGEABLE LAPEL

BACKGROUND OF THE INVENTION

This invention relates to jackets, particularly formal wear jackets, in which the appearance of the jacket can be readily changed by attachment or removal of an interchangeable lapel.

There are a myriad of fashion variations, whether in color, material or design, applicable to jackets. Typically when a variation of a jacket is needed a second jacket must be manufactured. To have both variations available would require owning both jackets with the attendant cost, as well as the financial exposure, particularly for formal wear rental establishments, when such variations become obsolete. Thus, there is a need for a jacket in which the fashion can be simply adjusted without the necessity of owning different jackets.

A number of means have been suggested in the art to modify or convert the appearance of a garment. U.S. Pat. No. 2535205 discloses a convertible jacket without a conventional or folded collar with a zipper for attaching and detaching collars. U.S. Pat. No. 3127617 discloses a garment such as a sweater with detachable garment trim. U.S. Pat. Nos. 1059542, 1691717, 2318829 and 2332734 all disclose detachable lapels wherein a replacement lapel completely covers an existing lapel. While effective in changing a garment's appearance these prior art references do so either in a cumbersome or ineffective manner or do not create a desired appearance.

The jacket of this invention is one which can be worn as is without the interchangeable lapel, and with the attachment of the interchangeable lapel a myriad of alternative fashion variations can be implemented through a simple adjustment.

BRIEF DESCRIPTION OF THE DRAWINGS

The following is a brief description of the drawings in which.

DESCRIPTION OF THE INVENTION

The jacket, in accordance with this invention, is made in a finished state with a conventional continuous folded collar and lapel and has a zipper for attaching and detaching an interchangeable collar and lapel member. The conventional collar and lapel provide support and shape for the interchangeable collar and lapel member and at least a portion of the conventional collar and lapel is outwardly visible when the interchangeable member is attached.

Figure 1:
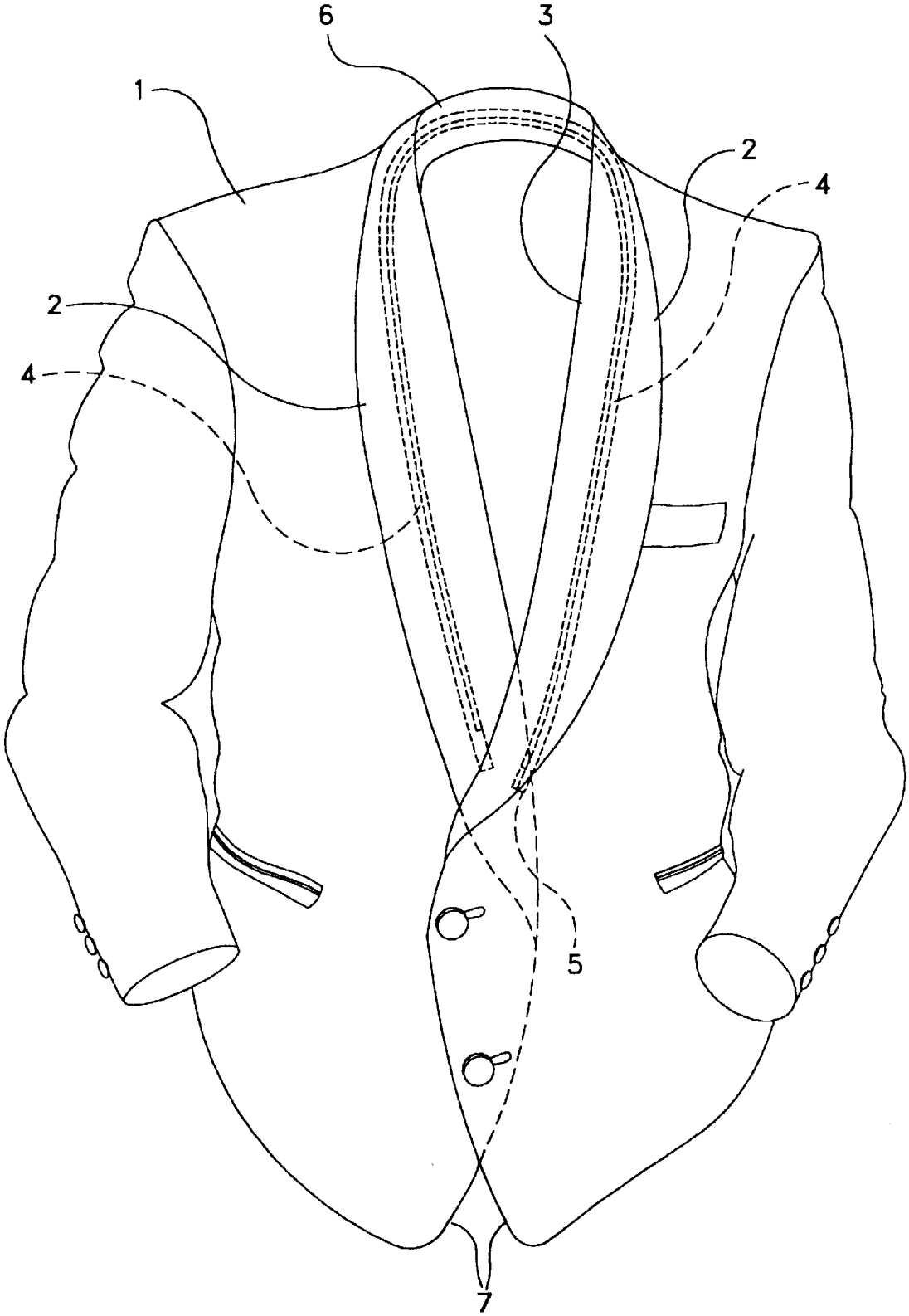
FIG. 1 is a front elevation view of a jacket without the interchangeable collar and lapel.

As shown in FIG. 1 the jacket 1, in its finished and unitary state, is made with a conventional finished folded collar and lapel 2. The collar and lapel 2 are finished so that the jacket may be worn without any attachments.

On the underside or inner face of the jacket around the folded edge 3 of the collar and lapel 2 is a zipper tape or strip 4 with a zipper slide 5. As shown, the neck portion 6 of the finished edge of the conventional collar and lapel continues into the curved and converging breast portions which, in turn, merge into the respective front edge portions 7.

It will be appreciated that different patterns of interchangeable collar and lapel members applied to the jacket will distinctly alter the character and appearance of the jacket. The members, for example, may be of different color and different material, and they may be of different design. A number of interchangeable members with different colors, materials and/or designs can be made to be applied to a single jacket, thus simply and readily altering the jacket's appearance as desired.

Figure 2:
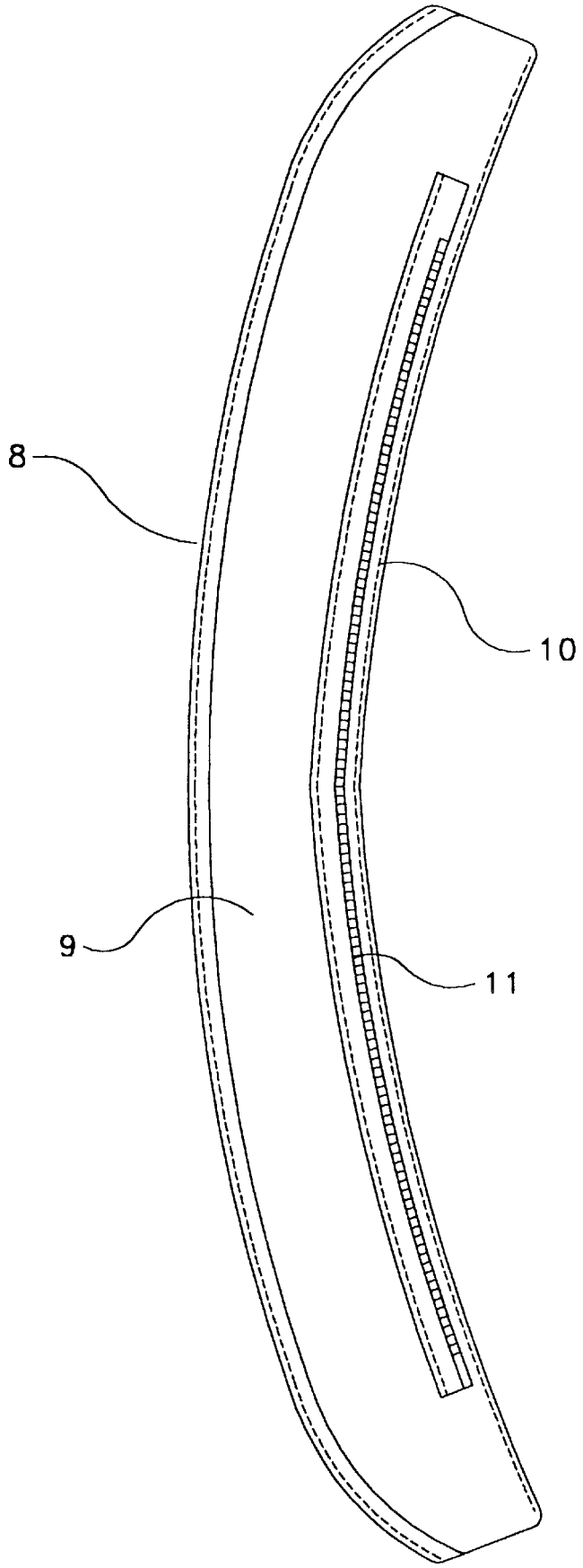
FIG. 2 is, an inside elevation view of an interchangeable collar and lapel unfolded and straightened out which is designed to be applied to the jacket of FIG. 1.
Figure 3:
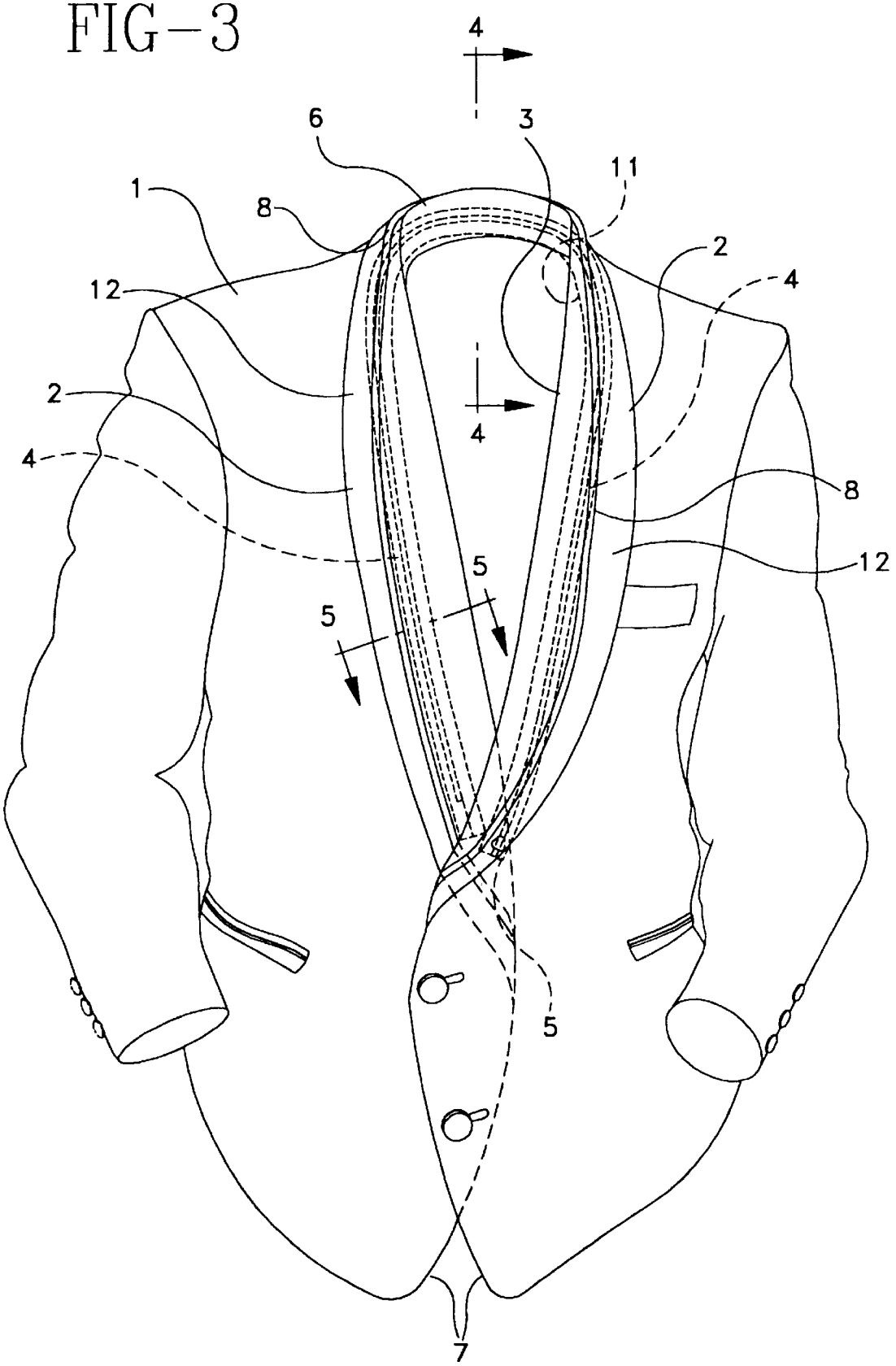
FIG. 3 is a view similar to FIG. 1 of the jacket with the interchangeable collar and lapel of FIG. 2 applied.

The interchangeable collar and lapel member 8, is shown in FIG. 3 attached to the jacket 1. This interchangeable member 8 is shown in FIG. 2. When attached, the member 8 assumes the contour and shape of the jacket's finished folded collar and lapel 2, but when unfolded it will lie flat as depicted in FIG. 2.

The interchangeable member 8 folds or turns over and fits about the conventional folded collar and lapel 2 thus making an outer fold 9 and an inner fold 10. A cooperative zipper strip 11 is secured on the inner face of the fold 10.

The interchangeable member 8 is folded so as to enclose the zipper strip 11 and to attach the member to the jacket the left end of the member's zipper, as shown in FIG. 2, is applied to the left end of the jacket zipper 4 as shown in FIG. 1, and the sliding of the zipper slide 5 completely around will attach the interchangeable member. The reverse movement of the slide will detach the member.

To allow for a variety of desired fashions to be implemented at least a portion of the finished collar and lapel is outwardly visible when the member is attached. In the embodiment shown in FIG. 3 the entire outer edge portion 12 of the conventional collar and lapel 2 is outwardly visible when the detachable member 8 is attached.

Figure 4:
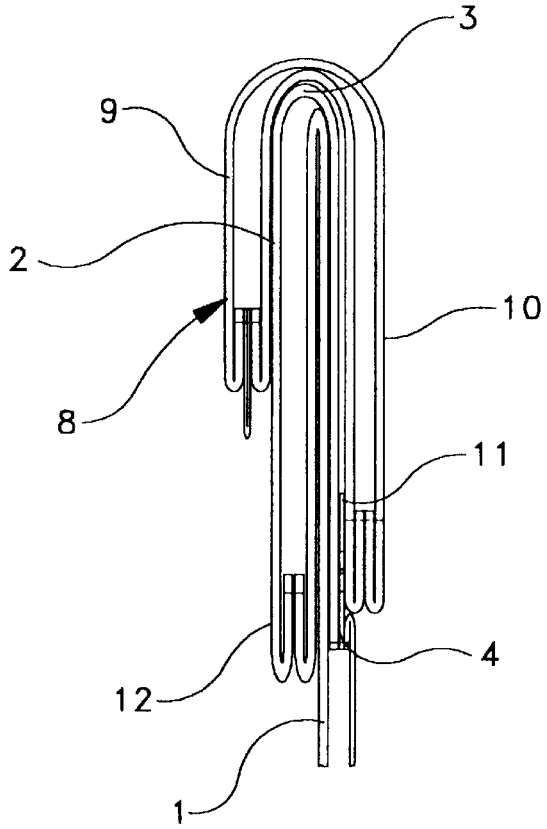
FIG. 4 is a fragmentary section on enlarged scale on the line 4—4 of FIG. 3.
Figure 5:
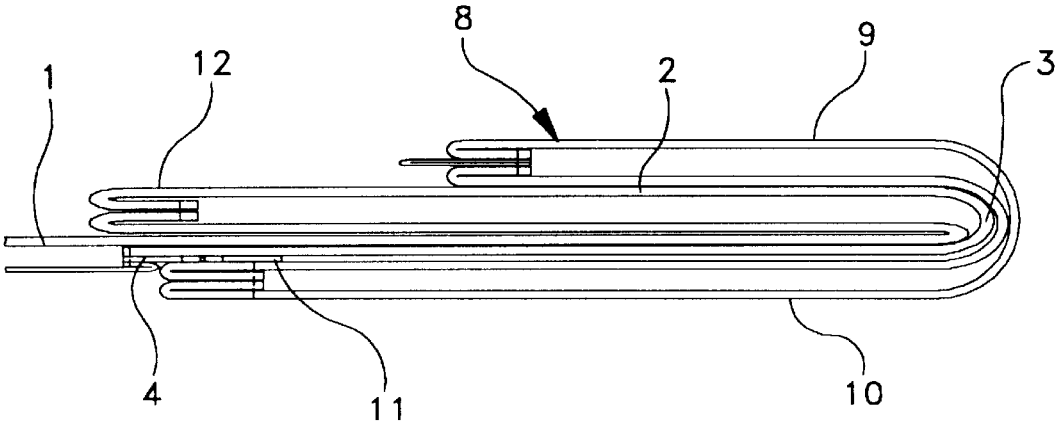
FIG. 5 is a fragmentary section on enlarged scale on the line 5—5 of FIG. 3.

FIGS. 4 and 5 show fragmentary sections of FIG. 3 along the lines 4—4 and 5—5, respectively. These cross sections show the attached interchangeable member 8 with the outer fold 9 visible and the edge portion 12 of the collar and lapel 2 also visible. Also shown is the zipper strip 4 of the collar and lapel 2 cooperatively engaged to the zipper strip 1 of the member 8.

What is claimed is:

1. A jacket comprising:

an open front jacket having a continuous finished collar and lapel having a folded edge about the neck and breast front, a zipper strip secured about the collar and lapel and spaced from a folded edge of the finished collar and lapel on the inner face thereof, and a unitary combined interchangeable collar and lapel member shaped to fit about said finished collar and lapel with a cooperative zipper strip on the inner face of the member for attachment to the zipper strip of the finished collar and lapel so as to be outwardly invisible, whereby the finished collar and lapel provides support and shape for the interchangeable collar and lapel member and at least a portion of the finished collar and lapel is outwardly visible when the member is attached.

2. Jacket of claim 1 wherein the entire out edge portion of the finished collar and lapel is outwardly visible when the member is attached.

* * * * *